US006056051A

United States Patent [19]

Coronado

[11] Patent Number: 6,056,051

[45] Date of Patent: May 2, 2000

[54] INTERNAL COILED TUBING CONNECTION WITH TORQUE CAPABILITY

[75] Inventor: Martin P. Coronado, Cypress, Tex.

[73] Assignee: Baker Hughes, Incorporated, Houston, Tex.

[21] Appl. No.: 09/018,517

[22] Filed: Feb. 4, 1998

[51] Int. Cl.[7] ..... E21B 23/01

[52] U.S. Cl. ..... 166/134; 166/217; 166/242.2; 166/242.6

[58] Field of Search ..... 166/77.2, 77.3, 166/75.14, 134, 139, 217, 242.1, 242.2, 242.6

[56] References Cited

U.S. PATENT DOCUMENTS

| | | | |
|---|---|---|---|
| 3,026,941 | 3/1962 | Muse | 166/134 X |
| 3,416,608 | 12/1968 | Crow et al. | 166/134 X |
| 3,749,166 | 7/1973 | Young | 166/134 X |
| 4,438,811 | 3/1984 | Patel | 166/134 X |
| 4,671,354 | 6/1987 | Henderson et al. | 166/134 |
| 5,251,695 | 10/1993 | Coronado | 166/380 X |
| 5,501,281 | 3/1996 | White et al. | 166/387 |
| 5,806,590 | 9/1998 | Lembcke | 166/134 |
| 5,845,711 | 12/1998 | Connell et al. | 166/77.2 X |
| 5,884,699 | 3/1999 | Mullen et al. | 166/134 |

FOREIGN PATENT DOCUMENTS

| | | |
|---|---|---|
| 2309721 | 8/1997 | United Kingdom . |
| WO 93/14294 | 7/1993 | WIPO . |

*Primary Examiner*—George Suchfield
*Attorney, Agent, or Firm*—Duane, Morris & Heckscher LLP

[57] ABSTRACT

A connection for coiled tubing is disclosed which has a feature built into it for resistance to torque transmitted from rotating equipment, such as a downhole motor. The connection fits up inside the coiled tubing and has a variety of rotational locks, along with a unique slip design to facilitate the resistance in the connection to applied torque from mud motors or other downhole equipment.

19 Claims, 2 Drawing Sheets

INTERNAL COILED TUBING CONNECTION WITH TORQUE CAPABILITY

FIELD OF THE INVENTION

The field of this invention relates to connectors in general and specifically to coiled tubing connectors which connect internally and provide torque resistance.

BACKGROUND OF THE INVENTION

Coiled tubing is in prevalent use to support a variety of downhole equipment in a variety of situations. In many cases, the coiled tubing must be advanced through existing wellbore restrictions such as production tubing. It is desirable in any event to connect the coiled tubing to downhole equipment in a manner which does not greatly increase the profile of the connection so that clearance problems are avoided. A dramatic advance in connector technology to facilitate the insertion of a variety of downhole tools using coiled tubing has been described in U.S. Pat. No. 5,251,695. In essence, this patent illustrates a technique for engaging a downhole tool to the inside diameter of the coiled tubing as opposed to designs prior to that time which had coupled to the coiled tubing on its outside diameter. Thus, the advance realized in U.S. Pat. 5,251,695 was a joint with a smaller nominal outside diameter which allowed matching the outside diameter of tool joints located below.

One feature not present in the connection illustrated in U.S. Pat. No. 5,251,695 is the ability to withstand torque transmitted to the connection. Designing slips to resist torque in a packer context has been tried, as illustrated in U.S. Pat. No. 5,501,281. Thus, it is an objective of this invention to allow not only the coupling of downhole equipment such as a mud motor to a segment of coiled tubing, but also to allow the connection therebetween to resist the torque reaction which occurs from operation of rotating downhole equipment such as a mud motor. Accordingly, a unique slip design has been combined with a configuration of slips and cones which are rotationally locked, all in a compact design. With these features, the torque reaction from a downhole mud motor is resisted in the joint to avoid a disconnection from the coiled tubing or a condition where the connection turns inside the coiled tubing. Those and other advantages of the invention will become more apparent from a review of the description of the preferred embodiment below.

SUMMARY OF THE INVENTION

A connection for coiled tubing is disclosed which has a feature built into it for resistance to torque transmitted from rotating equipment, such as a downhole motor. The connection fits up inside the coiled tubing and has a variety of rotational locks, along with a unique slip design to facilitate the resistance in the connection to applied torque from mud motors or other downhole equipment.

DETAILED DESCRIPTION OF THE PREFERRED EMBODIMENT

Figure 1:
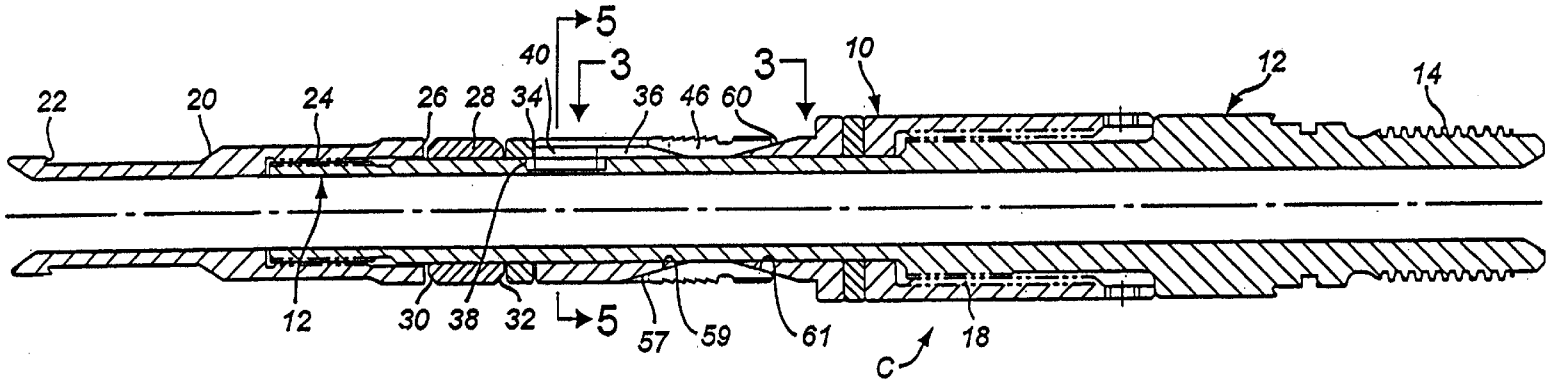
FIG. 1 is a sectional elevational view of the connector prior to inserting it into the coiled tubing end.

Referring to FIG. 1, the connector is made of an upper housing 10 and a lower housing 12. The lower housing 12 has a thread 14 which can be attached to a bottomhole assembly which includes a downhole motor. Lower housing 12 extends through upper housing 10 such that when relative movement occurs, the sealing element 28 and slip assembly 46 are placed in compression. Operation of the downhole motor (not shown) can exert a torque on the connector C. The objective of the present invention is to allow connection to coiled tubing 16 (see FIG. 2) in a manner that will allow the connection to resist applied torque, thus transmitting the applied torque into the coiled tubing.

Figure 3:
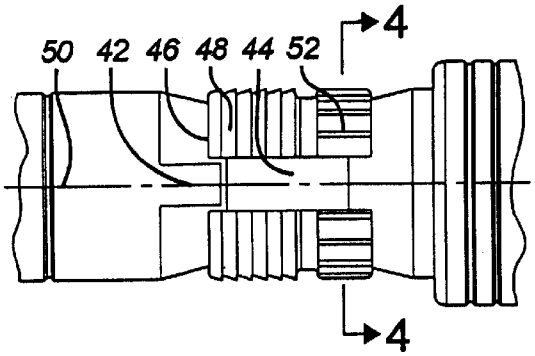
FIG. 3 is the view of lines 3—3 of FIG. 1.

The housings 10 and 12 are connected to each other at left-hand thread 18. At the upper end of the lower housing 12 is a fishing sub 20, which includes a fishing neck 22. Fishing sub 20 is connected to lower housing 12 at thread 24. Fishing sub 20 has a lower shoulder 26 which bears down on a sealing element 28. Sealing element 28 has anti-extrusion rings 30 and 32 disposed at its upper and lower edges, respectively. A cone 34 extends over the lower housing 12 below the sealing element 28. Cone 34 has an internal keyway 36 which, when aligned with keyway 38 in lower housing 12 with key 40 in the aligned keyways 36 and 38, results in rotationally locking the cone 34 to the lower housing 12. Cone 34, as shown in FIG. 3, also has a spline 42, which extends into a gap 44 of the slip assembly 46. Gap 44 increases in width as the slip assembly 46 is pushed by cone 34 against coiled tubing 16.

Figure 5:
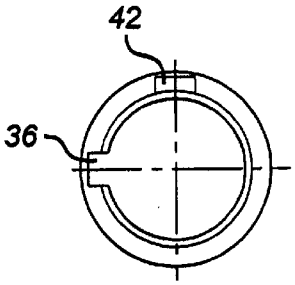
FIG. 5 is the view of lines 5—5 of FIG. 1.
Figure 4:
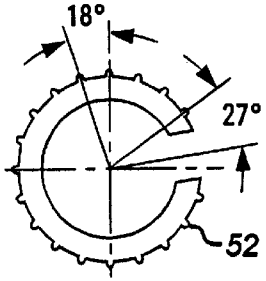
FIG. 4 is the view of lines 4—4 of FIG. 3.

Slip assembly 46 has a series of wickers 48. Wickers 48 are preferably at 90° to longitudinal axis 50, while wickers 52 are preferably substantially parallel to longitudinal axis 50. FIG. 4 illustrates a section through wickers 52 and indicates the shape of the slip assembly 42 as being generally a C-shape which defines gap 44. FIG. 5 illustrates the keyway 36 as well as the spline 42, showing them to be offset from each other by 90° in the preferred embodiment.

Figure 2:
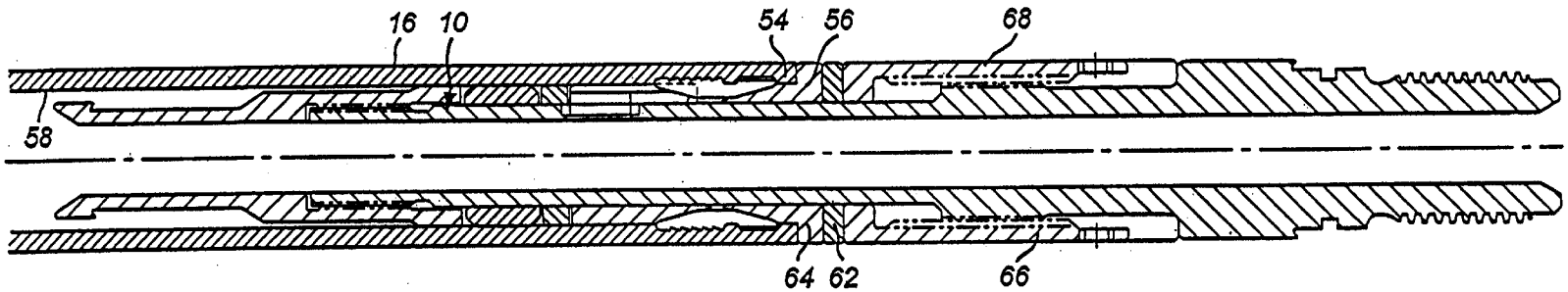
FIG. 2 is the view of FIG. 1, with the connector inserted into the coiled tubing end and the connection made up to the coiled tubing.

The operation of the connector C is fairly straightforward. The end 54 of the coiled tubing 16 is advanced until it contacts shoulder 56. At that point, the upper housing 10 is rotated to drive down the lower housing 12 with respect to upper housing 10, which, in turn, brings shoulder 26 closer to shoulder 56, which results in a compression of the sealing element 28 against the inside wall 58 of the coiled tubing 16. This occurs because taper 57 pushes under taper 59 on slip assembly 46. At the same time, the cone 34 is driven down toward slip assembly 46 which, in turn, pushes surface 61 of the slip assembly 46 up inclined surface 60, thus forcing the slip assembly 46 into contact with the inside wall 58 of the coiled tubing 16. Wickers 48 and 52 penetrate into the inside wall 58 of the coiled tubing 16. The connector C is now made up. The design as shown in FIGS. 1 and 2 can also incorporate a thrust bearing 62, which is disposed between a lower cone 64 which, in turn, has the sloping surface 60 on it, and sleeve 66. Cone 64 can also be rotationally locked to lower body 12. Beneath the thrust bearing 62 is retaining sleeve 66, which has the left-hand thread 18 to connect to the lower housing 12.

What is presented in the connector C above is a low-profile design which can be inserted into the end 54 of coiled tubing 16. The outside diameter of the connector C, as measured at its largest point 68, is generally no larger than the upsets of a threaded joint in the bottomhole assembly or can be the same outside diameter as the coiled tubing 16. Thus, for example, 2" coiled tubing can be run through a 2¼" opening, running a tool string which is 2⅛". The slip assembly 46 is not only compact, but with the wickers 48 and 52 aligned in different directions (perpendicular to each other in the preferred embodiment), the design is better able to resist torque, particularly using the wickers 52. Wickers 48 generally resist pull-out, while wickers 52 assist in resisting torque. Along the same lines, the use of a spline 42 to fixate the slip assembly 46 against rotation also strengthens the connector C in its ability to resist torque transmitted from a downhole motor or other downhole equipment. Finally, the rotational locking of cone 34 above the slip assembly 46 also serves to resist applied torque from a downhole motor.

The thrust bearing 62 can be a washer made of a material compatible with the temperatures and fluids in the wellbore.

If for any reason the coiled tubing 16 slips off connector C, a fishing neck 22 is exposed so that the bottomhole assembly can be easily retrieved in a known manner using an overshot.

Figure 8:
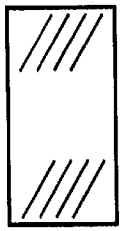
FIGS. 6–8 are alternative wicker arrangements.
Figure 7:
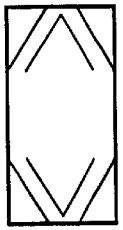
Figure 6:
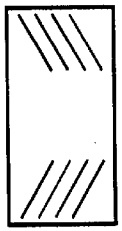

While the slip assembly 46 has been shown with wickers which are at 90° to each other, it should be noted that the angle of wickers 52 can vary such that wickers 52 are merely transverse instead of parallel to the axis 50 without departing from the spirit of the invention. Wickers 48 can also be oriented at different angles to the longitudinal axis 50 than at a transverse angle of 90°, as illustrated in FIG. 3. Alternatively, wickers 48 can be a mirror image to wickers 52, with both sets of wickers at an orientation crossing the longitudinal axis 50 at similar angles but in opposed orientation. Wickers 48 can all be respectively parallel to each other, as can wickers 52, while at the same time the wickers 48 as a group or the wickers 52 as a group can be at different transverse angles with respect to the longitudinal axis 50. Finally, wickers 48 and/or 52 do not need to all be substantially parallel to each other. Some wickers 48 can be in intersecting planes to other wickers 48, and the same is true with wickers 52. Some of these layouts are shown in FIGS. 6–8. Other orientations that promote resistance to applied torque and axial tension are all within the scope of the invention.

While the slip assembly 46 is shown as a unitary one-piece construction, the slip assembly 46 can be made from multiple segments with longitudinal splits and/or alternatively, the slip assembly 46 can be in different segments with an axial split separating one set of wickers from another. However, the preferred embodiment is as illustrated in FIGS. 1 and 3, and it results in the simplest construction which reliably resists torque from a downhole motor and axial tension.

The foregoing disclosure and description of the invention are illustrative and explanatory thereof, and various changes in the size, shape and materials, as well as in the details of the illustrated construction, may be made without departing from the spirit of the invention.

What is claimed:

1. A connector for running in and supporting torque-producing equipment from an internal surface of a tubular string, said tubular string extending into and distinct from the borehole or casing or tubular adjacent the borehole wall, said tubular string having an internal surface defining a bore therethrough, comprising:

a body;

a seal assembly supported by said body;

a slip assembly supported by said body, said slip assembly rotationally locked to said body;

said seal and slip assemblies insertable into the tubular string and extendable into contact with the internal surface of the tubular string to support the equipment for running into a well and to resist applied torque from the torque-producing equipment when it operates downhole.

2. The connector of claim 1, wherein:

said slip assembly comprising at least one slip having wickers thereon oriented to provide the grip force on the tubular in response to an applied torque.

3. The connector of claims 2, wherein:

at least some of said wickers are in substantial alignment with a longitudinal axis of said body.

4. The connector of claim 3, wherein:

at least some of said wickers are in substantially parallel planes which intersect a longitudinal axis of said body.

5. The connector of claim 2, wherein:

at least some of said wickers are substantially aligned with a longitudinal axis of said body while other wickers are in substantially parallel planes to each other, all of which planes intersect said longitudinal axis of said body.

6. The connector of claim 1, wherein:

said slip assembly having a generally cylindrical shape defining a longitudinal gap;

said slip assembly further comprising a cone;

said cone comprises a projection which enters said gap to prevent relative rotation of said slip assembly with respect to said cone.

7. The connector of claim 6, wherein:

said gap increases in width as said slip assembly is moved by said cone.

8. The connector of claim 6, wherein:

said body comprises a first groove;

said cone comprises a second groove such that when said cone is installed over said body and a key extends into said first and second grooves, said key rotationally locks said cone to said body while allowing relative translation therebetween.

9. The connector of claim 6, wherein:

some of the wickers are in a first group of parallel planes and others of said wickers are in a second group of parallel planes wherein all of said parallel planes intersect said longitudinal axis of said body.

10. The connector of claim 9, wherein:

said first group of parallel planes form a mirror image of said second group of parallel planes.

11. The connector of claim 5, wherein:

said slip assembly having a generally cylindrical shape defining a longitudinal gap;

said slip assembly further comprising a cone;

said cone comprises a projection which enters said gap to prevent relative rotation of said slip assembly with respect to said cone.

12. The connector of claim 11, wherein:

said gap increases in width as said slip assembly is moved by said cone.

13. The connector of claim 12, wherein:

said body comprises a first groove;

said cone comprises a second groove such that when said cone is installed over said body and a key extends into said first and second grooves, said key rotationally locks said cone to said body while allowing relative translation therebetween.

14. The connector of claim 13, wherein:

said wickers in said intersecting planes are separated from said wickers in said substantially parallel planes.

15. The connector of claim 1, wherein:

said body is in two pieces joined together by a thread such that said seal and slip assemblies are subjected to a compressive force when relative movement occurs due to manipulation of said thread.

16. The connector of claim 13, wherein:

said key is rotationally offset from said projection.

17. The connector of claim 15, wherein:

said thread is left-handed.

18. The connector of claim 1, wherein:

said slip assembly is disposed between opposing cones, at least one of which is rotationally locked to said body.

19. The connector of claim 15, further comprising:

a thrust bearing between said two pieces of said body.

* * * * *